US010233601B2

(12) United States Patent
Gerrard et al.

(10) Patent No.: US 10,233,601 B2
(45) Date of Patent: Mar. 19, 2019

(54) CRASH BARRIER

(71) Applicants: Robert Gerrard, Coventry (GB); Marcus Gerrard, Coventry (GB)

(72) Inventors: Robert Gerrard, Coventry (GB); Marcus Gerrard, Coventry (GB)

( * ) Notice: Subject to any disclaimer, the term of this patent is extended or adjusted under 35 U.S.C. 154(b) by 0 days.

(21) Appl. No.: 14/913,610

(22) PCT Filed: Jul. 31, 2014

(86) PCT No.: PCT/GB2014/052346
§ 371 (c)(1),
(2) Date: Feb. 22, 2016

(87) PCT Pub. No.: WO2015/033100
PCT Pub. Date: Mar. 12, 2015

(65) Prior Publication Data

US 2016/0376759 A1 Dec. 29, 2016

(30) Foreign Application Priority Data

Sep. 5, 2013 (GB) ..... 1315773.0
Dec. 3, 2013 (GB) ..... 1321290.7

(51) Int. Cl.
*E01F 15/06* (2006.01)
*E01F 15/14* (2006.01)
(Continued)

(52) U.S. Cl.
CPC ..... *E01F 15/06* (2013.01); *E01F 15/146* (2013.01); *E04H 17/08* (2013.01); *E04H 17/12* (2013.01); *E04H 17/22* (2013.01); *E04H 17/04* (2013.01)

(58) Field of Classification Search
CPC ..... E01F 15/06; E01F 15/146; E04H 17/04; E04H 17/08; E04H 17/12; E04H 17/22; E04H 17/261
(Continued)

(56) References Cited

U.S. PATENT DOCUMENTS 2,204,557 A * 6/1940 Ahles ..... E01F 15/06 256/13.1
2,410,228 A * 10/1946 Maxey ..... E01F 15/06 256/13.1
(Continued)

FOREIGN PATENT DOCUMENTS

JP H0726519 A 1/1995
RU 2159866 C1 11/2000
(Continued)

OTHER PUBLICATIONS

International Search Report issued by ISA/RU in connection with PCT/US2014/052346 dated Apr. 23, 2015.
(Continued)

*Primary Examiner* — Matthieu F Setliff
*Assistant Examiner* — Cory B Siegert
(74) *Attorney, Agent, or Firm* — Levenfeld Pearlstein, LLC

(57) ABSTRACT

A security barrier section includes two barrier section posts and at least one cable which extends between the two posts and is attached thereto, for example with U-bolts. Under impact of a vehicle the cable can slip to a limited degree. A security barrier includes a plurality of the security barrier sections and adjacent security barrier sections share a common barrier section post.

17 Claims, 19 Drawing Sheets

(51) Int. Cl.

| | |
|---|---|
| ***E04H 17/08*** | (2006.01) |
| ***E04H 17/12*** | (2006.01) |
| ***E04H 17/22*** | (2006.01) |
| *E04H 17/04* | (2006.01) |

(58) Field of Classification Search
USPC ..... 256/13.1, 48, 52, 55
See application file for complete search history.

(56) References Cited

U.S. PATENT DOCUMENTS 2,518,004 A 8/1950 Greenwell
3,077,339 A * 2/1963 White ..... E01F 15/0453 256/13.1
3,210,051 A * 10/1965 Case ..... E01F 15/06 256/13.1
3,292,909 A * 12/1966 Bianchi ..... E01F 7/06 256/13.1
4,780,020 A * 10/1988 Terio ..... E01F 13/048 404/6
5,299,781 A * 4/1994 Barrett ..... E04H 17/08 256/1
5,660,496 A * 8/1997 Muller ..... E01F 15/146 256/13.1
6,932,327 B2 * 8/2005 Alberson ..... E01F 15/06 256/13.1
7,556,243 B2 * 7/2009 Williams ..... E01F 15/06 256/12.5
2008/0296546 A1 * 12/2008 Bergendahl ..... D07B 1/0673 256/13.1
2009/0218554 A1 * 9/2009 Mauer ..... E01F 15/06 256/13.1
2010/0219390 A1 * 9/2010 O'Banion ..... E01F 13/028 256/1
2012/0207541 A1 * 8/2012 Maus ..... E01F 15/086 404/6
2013/0181178 A1 * 7/2013 Akerstrom ..... E01F 15/06 256/13.1
2014/0014359 A1 1/2014 Garrett et al.

FOREIGN PATENT DOCUMENTS

SU 945386 A1 7/1982
WO 2009030549 A1 3/2009
WO 2010086581 A1 8/2010

OTHER PUBLICATIONS

International Search Report issued by the ISA/EP in connection with PCT/BG2014/052346 dated Oct. 15, 2014.

* cited by examiner

CRASH BARRIER

This is a National Stage Application of International Patent Application No. PCT/GB2014/052346, filed Jul. 31, 2014, which claims the benefit of and priority to Great Britain (GB) Patent Application Nos. 1315773.0, filed Sep. 5, 2013, and 1321290.7, filed Dec. 3, 2013, the entireties of which are incorporated fully herein by reference.

BACKGROUND

This invention relates to security barriers. In particular, this invention relates to a security barrier that is effective when installed in soft ground.

Security barriers, or crash barriers, the main purpose of which being to prevent the passage of vehicles, are widely known in the art and have many applications. Common applications are for bordering dangerous sections of roads, providing a central separation between lanes of traffic moving in opposite directions, and around secure areas, for example around the entrance to airports or the like.

Known security barriers are generally made of metals, in particular steel, and comprise a post, which is bedded in concrete, and to which a barrier is attached. To provide the structural integrity to stop a car moving at around 40 to 50 km/h (about 25 to 30 mph), such barriers need a very deep, reinforced bedding of around a meter in depth and, for larger trucks, a bedding of up to two meters, into which the posts are set. As well as the obvious disadvantages in terms of the amount of material needed and the increased complexity of excavating to the required depth, the necessity of burying the posts to such a depth often interferes with existing buried services, for example electricity cables and sewage or water pipes. Although many are marked and can be anticipated during the planning stage, the discovery of pipes during deep excavation is common and necessitates halting excavation until the nature of the pipe/cable has been ascertained.

Typical designs of security fencing comprise a number of posts with tensioned steel cables between them. These fences typically run in lengths of in excess of a minimum of 50 meters, usually in excess of 100 meters. They generally comprise a very large end stop which will have a very large mass of concrete embedded in the ground, and against which the cables are tensioned. These systems have a number of problems associated with them. One of the problems is that if the fence is installed in uneven ground, i.e., if there is not a level line of sight between the two ends of the fence, between which the cables are tensioned, then tensioning the cable will place a load on each post, either pushing it into, or pulling it out of, the ground. A further problem is that due to the tensile nature of these fences, they may not be well suited for use in soft ground. This will increase the problem of the tensile forces acting on the posts which, if they are set in solid ground, may be acceptable to a degree. To date, so far as can be determined, none of these types of fences have managed to meet the stringent requirement of a PAS68 type test in soft ground.

It is the purpose of the present invention to provide an improved security barrier that at least partially mitigates the problems associated with the existing designs.

SUMMARY

According to a first aspect of the present invention, there is provided a security barrier section comprising: two barrier section posts and at least one cable extending between said two posts and attached thereto by attachments, wherein said attachments are configured to allow said cable to slip in said attachment under loading.

The at least one cable may comprise a stop at either end thereof and the extent of slip of the at least one cable in said attachment may be limited by said stops.

By the present invention, the limited amount of slip allowed upon initial impact reduces the impact force on the posts and absorbs some of the initial energy of the impact. This results in a more gradual loading of the barrier posts when the cables are struck.

In one arrangement, a loop is formed in at least one end of the at least one cable, and the loop is passed over a barrier post, said loop forming said stop. In another arrangement, a crimp is attached to at least one end of the least one cable, said crimp forming said stop. The cables can therefore only slip until the stop comes into contact with the post, whereupon full loading is transferred to the post. However, as the initial impact has been absorbed—at least in part—as the cable slips at the attachment, the peak instantaneous loading is reduced.

In one arrangement, the attachments comprise clamps which clamp the at least one cable against each said barrier section post. The clamps may, for example, comprise one or more U-bolts passing through holes provided in the barrier section posts. It will be appreciated that more than one cable may extend between the two posts. For example, three cables may be provided at different heights, and where this is the case, each cable may have a corresponding clamp.

The U-bolts may be tightened to a torque in the range of 5.65 to 11.30 Nm (50 to 100 inch pounds). The U-bolts may be tightened to a torque in the range of 7.34 to 9.60 Nm (65 to 80 inch pounds). Alternatively, the U-bolts may be tightened to a torque of 8.47 Nm (75 inch pounds)±10%.

In one arrangement, the at least one cable comprises a multi strand steel cable.

In one arrangement, each barrier post comprises a footing for anchoring the post in the ground, and a resilient means may be provided between each said cable and said footing. The resilient means may comprise a resilient section of said barrier post extending from the footing and to which said at least one cable is attached, said resilient section comprising spring steel. I.e., at least a section of the barrier post to which the wire is attached is made of spring steel. In addition, the majority of the post, including the footing, could be made of spring steel.

In use, each of said plurality of barrier posts are set in a concrete foundation, which is preferably re-enforced with, for example, metal rebar.

Optionally, a support post may be located between the two barrier section posts and configured to support said at least one cable. This will prevent any sagging of the cable between the two posts and ensure it is retained at an appropriate height to obstruct any vehicles attempting to pass the barrier.

The security barrier section may comprise one or more impact posts located between the two barrier section posts. The impact posts are provided as an additional impediment for a vehicle attempting to pass the barrier. Conveniently, the impact posts are located on a side of the barrier on which an impact is expected from an approaching vehicle. An approaching vehicle will impact not only on the cables of the security barrier section but also the impact posts, whereby the kinetic energy of the impact can be distributed over the cables and the one or more impact posts.

The impact posts have a height of up to about 0.5 meter above ground, so that they may fit under a bumper of a conventional truck. As an assaulting vehicle rides over the impact post or posts, the impact posts cause structural damage to the undercarriage of the vehicle. For instance, the axles of the vehicle may snap.

It is understood that the impact posts are spaced apart so that a vehicle cannot drive between them.

Without wishing to be bound by theory, it is believed that the one or more impact posts further increase the barrier effect by acting on the axles or other parts of a vehicle's undercarriage. The impact barrier may cause the axles to break, either before, during, or after impact on the cables, and thereby further reduce the impact force on the cables of the security barrier section. A thus immobilised vehicle becomes itself an obstacle blocking the section it has just attempted to breach. This impedes an assault method involving two vehicles.

To better illustrate this, a two-vehicle assault can involve sending a first vehicle to breach a barrier in the anticipation by the attacker that the first vehicle will be stopped, followed by a second vehicle which pushes the first vehicle forward through the breached barrier to make way. A two-vehicle assault is impeded because the impact posts are provided to cause damage to the first vehicle and thereby impede an attempt to push it further. A second vehicle, rather than pushing the first vehicle away, may be immobilised itself, by impacting on the first vehicle.

It is believed that additional impact posts are beneficial in particular for end barrier sections. Mid barrier sections are to some extent enforced laterally, from both sides, by the cables of the adjacent barrier sections that are connected on both sides. End barrier sections, however, are only connected to one adjacent barrier section, and thus the support by adjacent cables is only provided on one side. Thus, mid barrier sections have been found to withstand a vehicle impact more readily than end barrier sections. End barrier sections are thus believed to be more susceptible to a breach upon impact.

According to a second aspect of the invention, there is provided a security barrier comprising a plurality of security barrier sections according to the first aspect of the invention, wherein adjacent security barrier sections share a common barrier section post. In this manner, a security barrier of any length can conveniently be put together by assembling a plurality of the sections described above. By sharing common posts, the number of posts can be reduced. Furthermore, by sharing common posts, the slip of the cable through the attachments can progress from one section to the next, which further reduces the point load and will enable a far more gradual loading of the individual posts.

The attachment means may comprise U-bolts passing through said security barrier section posts, wherein said at least one cable of adjacent security barrier sections share common U-bolts. Preferably, two U-bolts are provided adjacent each other on each shared post, each U-bolt clamping two cables extending in opposite directions from the shared barrier post.

The security barrier may comprise an anchor post at at least one end thereof, said anchor post set in a common concrete bed with the adjacent end of one of said barrier section posts. In one arrangement, both barrier section posts of an end security barrier section of said security barrier may be set in a common concrete bed. Alternatively or additionally, the one or more impact posts may be located in a common concrete bed.

In one arrangement, at least one anchor cable may extend between said anchor post and an adjacent one of said barrier section posts of said end security barrier section. Alternatively, in another arrangement, at least one anchor cable may extend between said anchor post and the end of said at least one cable attached to an adjacent one of said barrier section posts of said end security barrier section. The anchor post may be made of spring steel and therefore provide additional resilience to the end post of said security barrier when impacted. Optionally, the at least one anchor cable may be attached to said anchor post by attachments, which are configured to allow said cable to slip in said attachment under loading. The at least one anchor cable may be attached to said anchor post by U-bolts.

In an embodiment of the second aspect, at least one common barrier section post constitutes a corner arrangement between two adjacent barrier sections, wherein two adjacent barrier sections are arranged with an included angle of less than 180° between them. The included angle may be about 170°, 160°, 150°, 140°, 135°, 130°, 120°, 110°, 100°, 90°, 80°, 70°, 60°, 50°, 45°, 40°, 30°, or 20°. By "about", it is meant that the angle may deviate by ±10° or ±5° in practical circumstances.

Embodiments of the invention may comprise a fence section. The fence section may provide additional protection against intrusion, to complement the vehicle mitigation function of the barrier sections of the invention. The fence section may be erected in front of the barrier, i.e., on the side of the barrier from which an impact is expected, or behind the barrier, i.e., on the side of the barrier away from the expected impact. The fence section may be of any height or configuration as may be required, e.g., to hinder trespassing or climbing by individuals, or to provide a visual shield. It is not necessary that the fence section is configured particularly for withstanding an impact by a vehicle, because the vehicle impact mitigation function is provided by the cables of the barrier sections.

BRIEF DESCRIPTION OF THE DRAWINGS

Specific embodiments of the invention are described below, by way of example, with reference to the accompanying drawings, in which.

DETAILED DESCRIPTION

Figure 1:
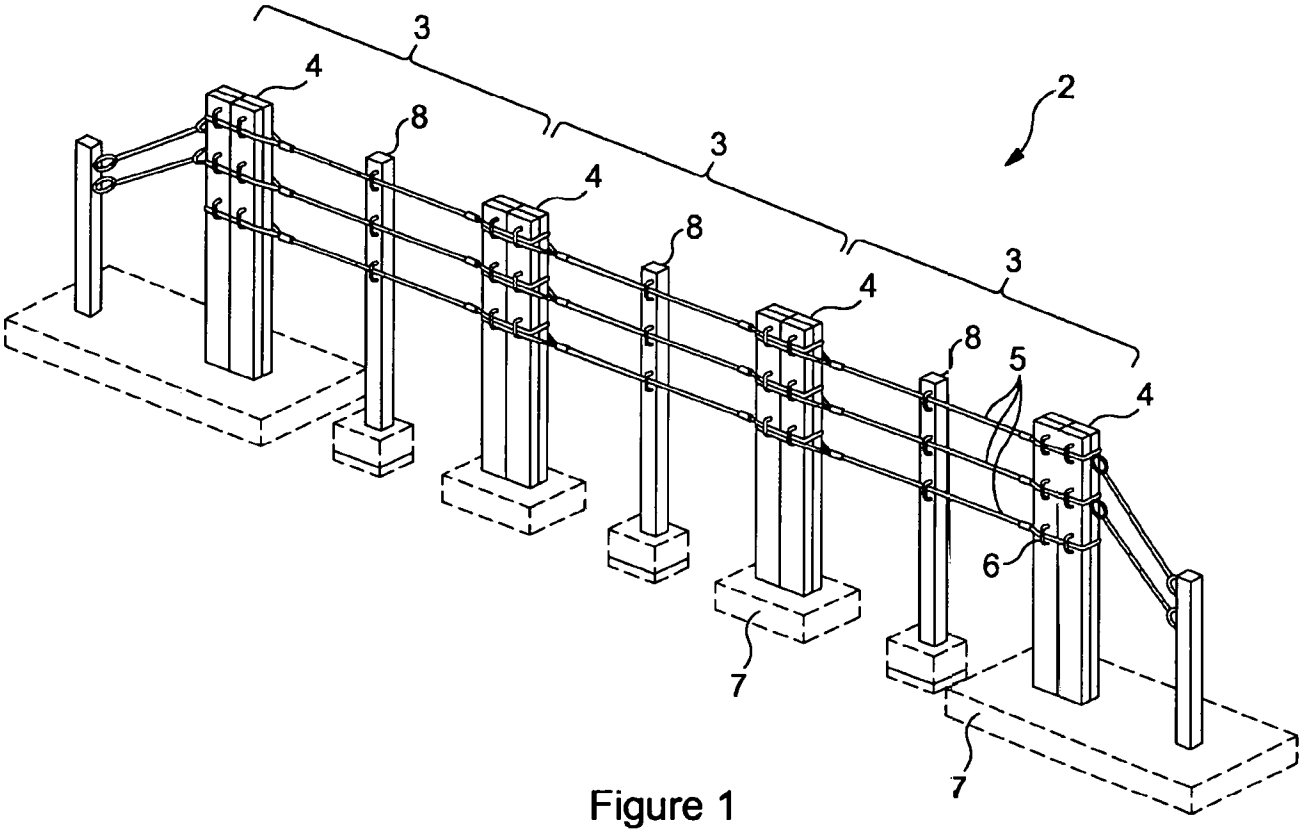
FIG. 1 shows a perspective view of a security barrier of the present invention.
Figure 10:
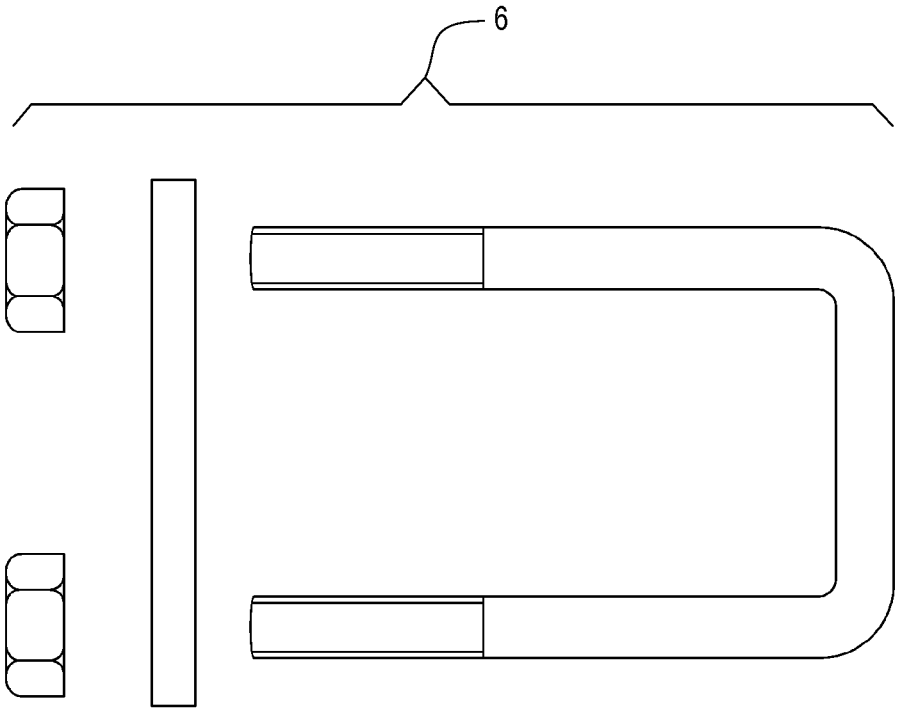
FIG. 10 shows a U-bolt for attaching the cable to the posts.
Figure 12:
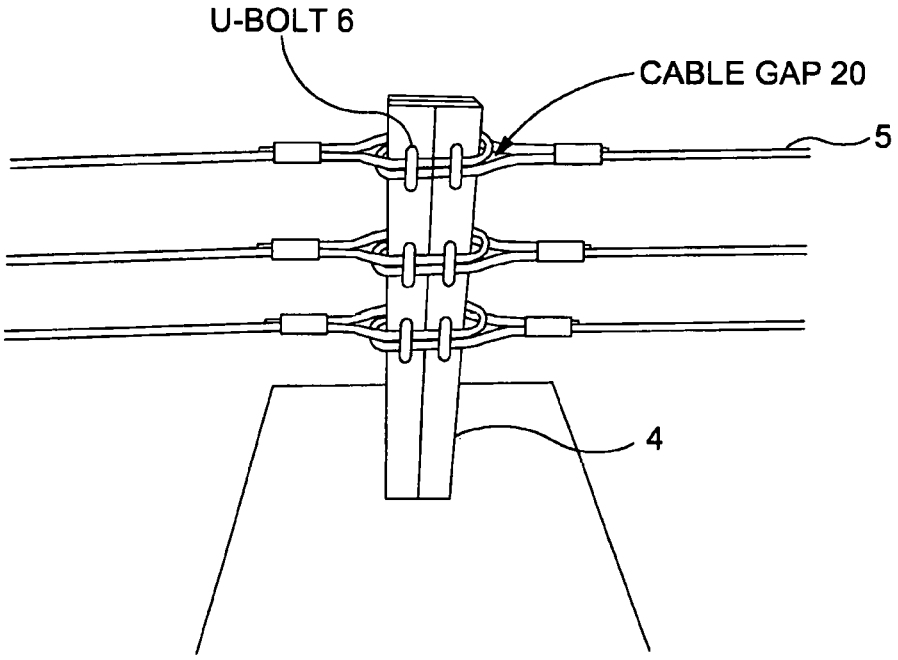
FIGS. 12 and 13 show front and rear views of the attachment of the cable to a post of a barrier according to the invention.
Figure 13:
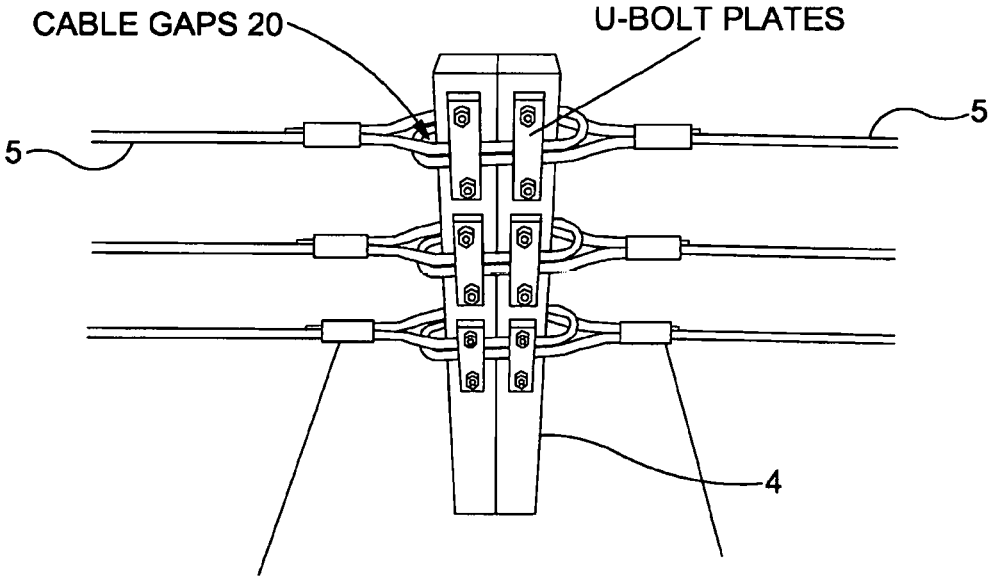

Referring to FIG. 1, a security barrier 2 is shown which comprises three security barrier sections 3 of the invention. Each security barrier section 3 comprises two barrier section posts 4, with adjacent barrier sections 3 sharing a common barrier section post 4. Extended between each pair of barrier section posts 4 are three cables 5. The cables 5 are attached to each security barrier post by a plurality of U-bolts 6 (see FIG. 10) in a manner such that under impact a limited amount of slip of the cable within the U-bolts is permitted. Further details of this will be described below, in particular with reference to FIGS. 2, 12 and 13.

Each of the security barrier posts 4 are set in a concrete foundation 7 which, in use, will be situated such that its top surface is substantially flush with the ground in which it is located.

A support post 8 is located between each of the barrier posts 4, the purpose of the support post 8 being to prevent the cables 5 sagging between the barrier posts 4. It will be appreciated that in order to form a reliable barrier, in particular one which is intended to stop vehicles, it will be necessary that the cables 5 are maintained at a correct height above the ground. This ensures that they are correctly positioned to best resist vehicular movement. As the distance between the security barrier posts 4 may be in the order of 7 to 8 meters, the support posts 8 assist in maintaining the correct level above the ground in between the barrier posts 4. Although FIG. 1 is shown as having a U-bolt 6 passing through the support post 8 to maintain the cable at the required level, in an alternative arrangement the U-bolt 6 passes around the exterior of the support post 8 and has a hook or plate attached thereto, arranged to support the cable 5 between the hook/plate and the post. With this arrangement the position of the level of the cable 5 is not limited by the size of the U-bolt 6 as it may be slid to any desired height. Additionally, under impact the cable 5 is able to pull from the support post 8 which assists in preventing the support post 8 from pulling the cable 5 towards the ground as a vehicle, striking the fence in the vicinity of the support post 8, attempts to pass the fence. I.e., the cable 5 can be released and is then stretched taught between the barrier posts 4 at either end which are the load bearing elements.

Figure 2:
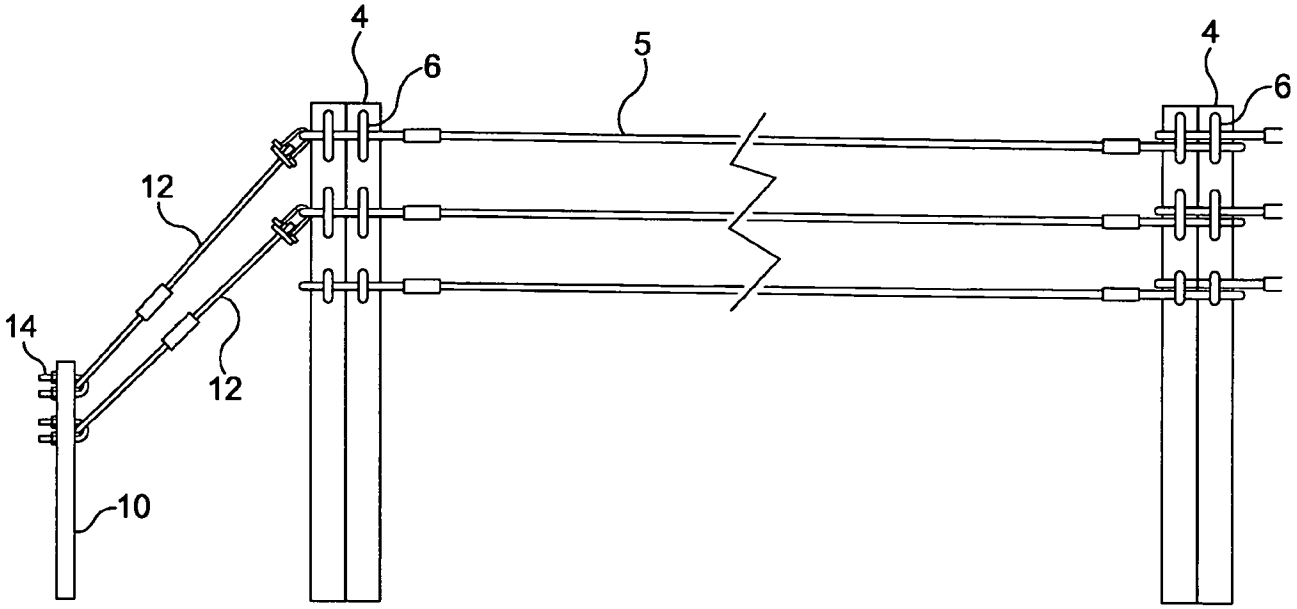
FIG. 2 shows a side view of the end barrier section of the security barrier of FIG. 1.

Referring now to FIG. 2, a detail of a security barrier section 3, configured to be placed at the end of a security barrier 2, is shown. It will be appreciated that in this diagram only the above-ground sections of the security barrier section are shown.

Security barrier posts 4, cables 5 and U-bolts 6 are all as shown in FIG. 1. In addition, an anchor post 10 is provided adjacent the barrier post 4 at the end of the security barrier 2. As can be seen from FIG. 1, the anchor post 10 shares a common foundation with the barrier post 4 adjacent which it is located. I.e., they are set in the same concrete foundation. In an alternative arrangement, the entire end barrier section of the security barrier 2 may share a single common concrete foundation.

Cable loops 12 are connected from the anchor post 10 to the ends of the cables 5 of the end security barrier section. As can be seen, the cable loops 12 are attached to the anchor post 10 by means of U-bolts 14. However, it will be appreciated that other suitable means of fixing may be used.

Figure 3A:
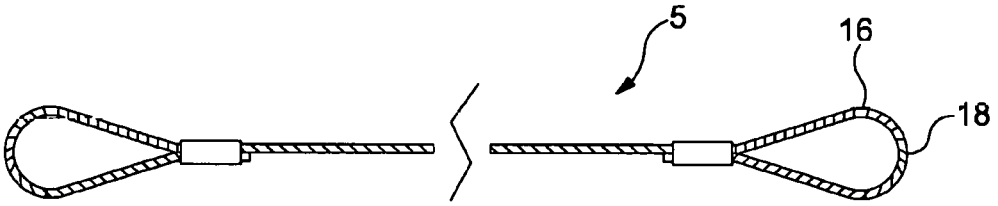
FIG. 3 shows a cable sling for use with the security barrier of FIGS. 1 and 2.
Figure 3B:
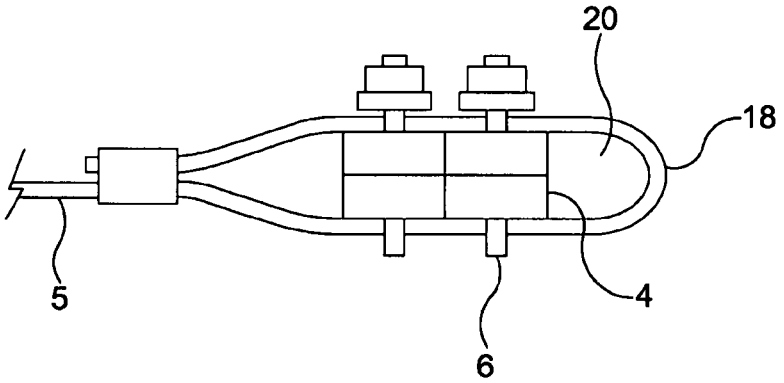

FIG. 3*a* shows a cable 5 for use in the invention. As can be seen, a loop 16 is formed in either end of the cable 5 by turning the end of the cable back on itself and securing it using a ferrule. The loops 16 are made such a size that they can be passed over the top of the barrier posts 4, and the overall length of the cable 5 is such that when the cables 5 are placed with their loops passed over the top of the barrier posts 4, the loop is sufficiently large that they can move longitudinally over the posts. When assembled, the cables 5 are pulled tight and the loops are clamped to the barrier posts 4 by the U-bolts 6. As can be seen from FIGS. 11 and 12, which show a barrier post with the cables clamped to it from both front and the rear, when the cables are pulled tight between the posts, a section of the loop will extend past the post so that there is a gap between the post and the end of the loop 18. This is shown in detail in FIG. 3B, which shows a top tier of a loop 16 of a cable 5 passed over a security barrier post 4. As can be seen, the loop is sufficiently sized such that a part of it can be pulled past the post 4 such that when the U-bolts 6 are clamped tight against the cable 5 a cable gap 20 is formed between the end of the loop 18 and the post 4.

The U-bolts 6 are tightened against the loop 16 of the cable 5 such that it is clamped in place, but not sufficiently tightly that under pressure the cable loop 16 is not able to at least partially slip past the U-bolt 6. As the cable slips, the U-bolt 6 provides a resistive force opposing the slip, the extent of which will be dependent upon the torque with which the U-bolts are tightened. In the example which was tested, the nuts of the U-bolt 6 were tightened to a torque of 75 pound force inch (8.47 Nm), although it will be appreciated that other torques may be applicable, depending on the extent of stretch required. The U-bolt nut torques in the order of 5.6 Nm to 11.3 Nm (50-100 pound force inch), may be applicable and, more preferably, torques in the range of 7.3 Nm to 9.6 Nm (65 to 85 pound force inch) may be used.

Under impact, as force is applied to the cables 5, the loop 16 passes through the U-bolts until the end of the loop 18, which acts as a stop, abuts the barrier post 4. As the loop abuts, the full loading is then transferred to the posts. This gradual loading of the posts, by allowing a limited slip of the cable against a restraining force (the clamping of the U-bolts), greatly reduces the initial shock loading of the posts under impact, and also the shock loading of the cables 5 along their length. Although it will be appreciated that the overall force which the barrier must absorb will be the same, irrespective of the barrier design (as it is dependent on the mass and speed of the moving vehicle which it needs to stop), the time envelope in which the force is absorbed is lengthened by allowing this limited slip through the U-bolts upon impact, thereby decreasing the maximum instantaneous force applied to the barrier and cable.

The cable used in testing of this design was a multi strand steel cable. However, it will be appreciated that cables of other materials, for example composite cables or the like, may also be used.

Referring now to FIGS. 4 to 7, a security barrier post which can be used with this invention is described in greater detail. Generally, the post will comprise an upright section extending from the ground to which the cables 5 are attached, and a footing which will be set in the concrete foundation 7. It will be appreciated that the upright section and the footing may consist of a single piece or may, alternatively, be separately constructed so that the upright sections of the posts 4 can be inserted into the footing after it has been set in the foundation. A suitable design of post to which the cables may be attached is disclosed in the published patent application WO 2010/086581, the entire contents of which are incorporated herein by reference.

Figure 4:
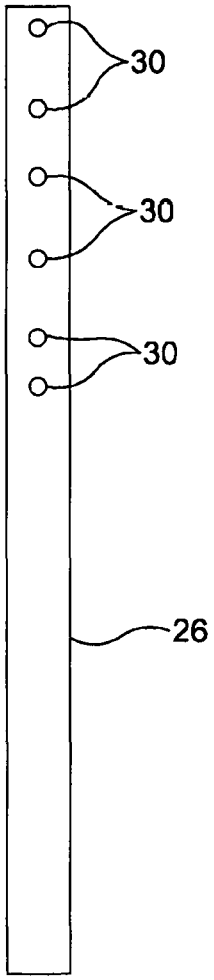
FIGS. 4 and 5 show a front and back spring post for use in the invention.
Figure 5:
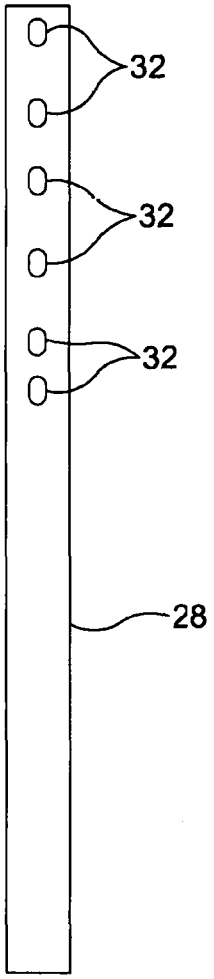

Turning to FIGS. 4 to 7, the post of the invention may comprise a footing which has a tubular section 24 into which a plurality of upright post sections 26, 28 may be inserted. The security barrier 2 will have a side from which the impact is expected to arrive, and a side away from which the impact is expected to arrive, and the upright post sections 26, 28 are arranged adjacent to one another in a direction facing that from which impact is expected to arrive. The lower end of the post sections 26, 28 are received within the tubular section 24. As shown, for example, in FIG. 1, the barrier posts 4 each comprise two upright post sections 26 arranged side by side, and two upright post sections 28 arranged side by side behind the upright post sections 26. As shown in FIGS. 4 and 5, the post sections 26 are provided with a plurality of pairs of holes 30 through which the U-bolts are passed, and the post section 28 comprises a plurality of slots 32 which the U-bolts also pass. By providing holes in one of the upright post sections and slots in the other, any vertical misalignments of the posts, which may occur when they are inserted into the footings, are compensated by the slots, such that the U-bolts can still pass through both post sections. Furthermore, by having slots in the rear post, under impact, when flexion of the front and back post section causes relative movement of their abutting faces, the provision of slots prevents the movement shearing the U-bolt, which would otherwise occur, thereby removing the clamping force on the cables, and possibly permitting the cables to be torn from the posts.

The post sections 26 and 28 are manufactured from spring steel and, as such, they have their own natural resilience such that, when the security barrier 2 is impacted, for example when it is struck by a vehicle, not only is the time period over which the impact is experienced in the security barrier 2 extended by means of controlled slip of the loops within the U-bolts, but as the posts are naturally resilient, due to their spring steel material, this will further extend the time period over which the impact is experienced, helping in reducing peak loading in the barrier. In particular, the design of the security barrier of the invention reduces the instantaneous shock loading of the footing, which, in a soft ground environment, is a potential weak point of the barrier, as high instantaneous shock loading could cause failure at these points.

Figure 6:
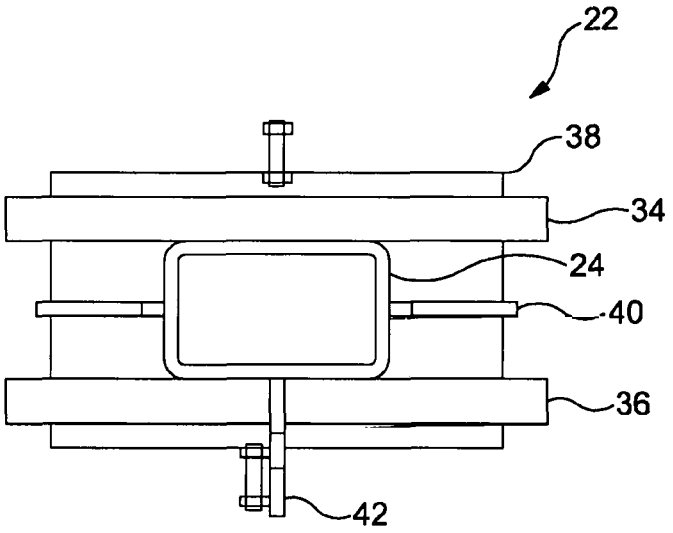
FIGS. 6 and 7 show a top and a rear view side of a footing for the front and back posts shown in FIGS. 4 and 5.
Figure 7:
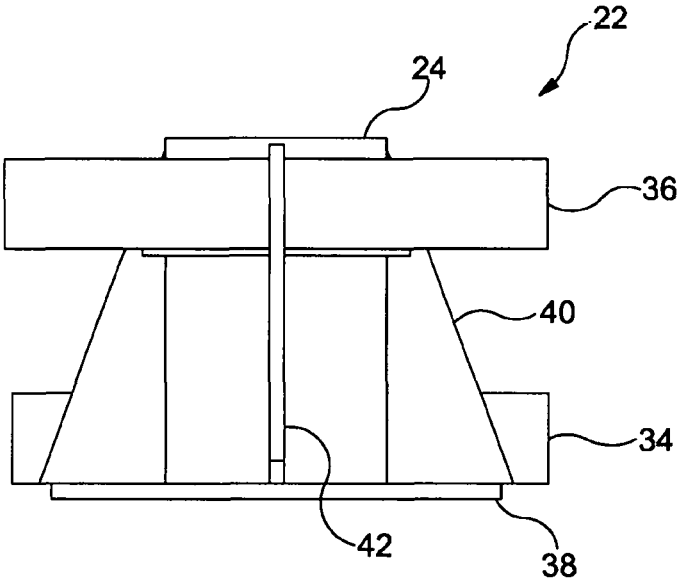

Referring to FIGS. 6 and 7, a post footing is shown. The post footing 22 comprises a tubular section 24 which is provided with a foot plate 34 and a top plate 36. The foot plate is provided at the lower end of the tubular section 24, substantially at the bottom of the footing, and the top plate 36 is provided adjacent the opposite side of the tubular section, substantially at the top of the footing. The foot plate 34 and the top plate 36 are also both manufactured of a spring steel material. The footing 22 is located in the concrete foundation 7 in an orientation such that the foot plate 34 is disposed on the side of the footing, facing the direction from which impact is expected, and is arranged substantially parallel to the run of the barrier. In this manner, when the fence is impacted, the load is transferred via the posts 4 into the footing 22, this will create an attempted rotation of the footing in the foundation. The foot plate 34 and top plate 36 are located such that the load experienced at the bottom forward edge of the footing 22 and the top back edge of the footing is distributed over a larger area and, as these components are manufactured of spring steel, they are naturally resilient to any attempted movement or rotation.

In addition, the footing has a base plate 38 on which the tubular section 24 sits. Side plates 40 extend from the tubular section outwards and extend substantially from the top of the tubular section 24 to the base plate 38. These side plates assist in preventing rotation of the footing within the foundation about the longitudinal axis of the post sections 26, 28, as does a similar back plate 42 which extends from the back face of the tubular section in a rearward direction.

Figure 8:
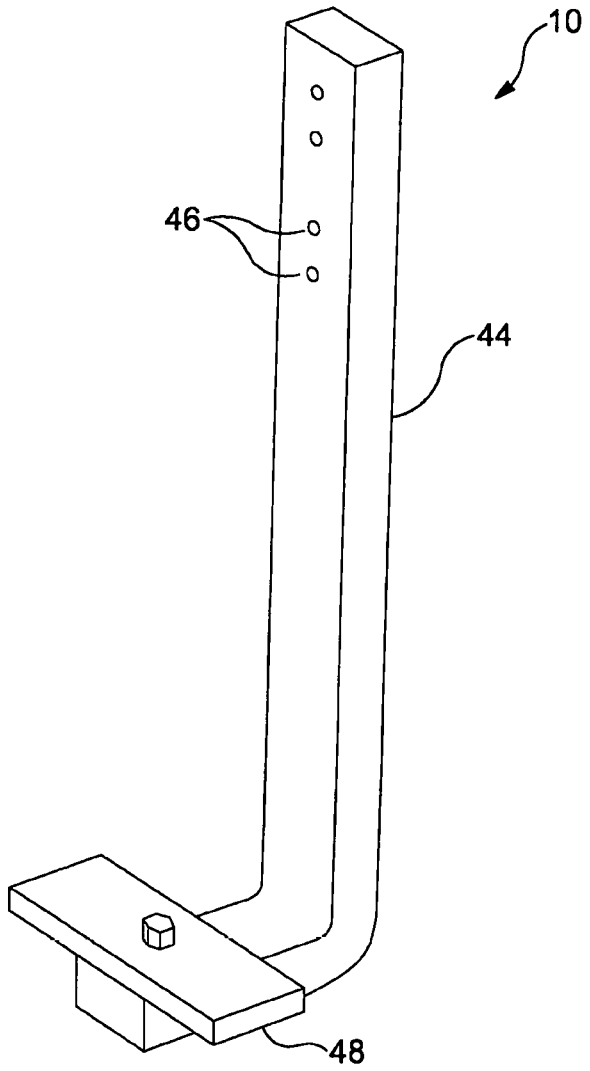
FIG. 8 shows a perspective view of an end anchor post for use in the invention.

Referring now to FIG. 8, an anchor post for use in the invention is shown. The anchor post comprises a bent spring steel bar, which has an upper section having U-bolt holes 46 therein and which extends above the ground, and a lower section, including the bent end, which, in use, is set below ground in the concrete footing. A load spreader plate 48 is attached to the end of the bent section and extends substantially perpendicular to the anchor post 10.

Figure 9:
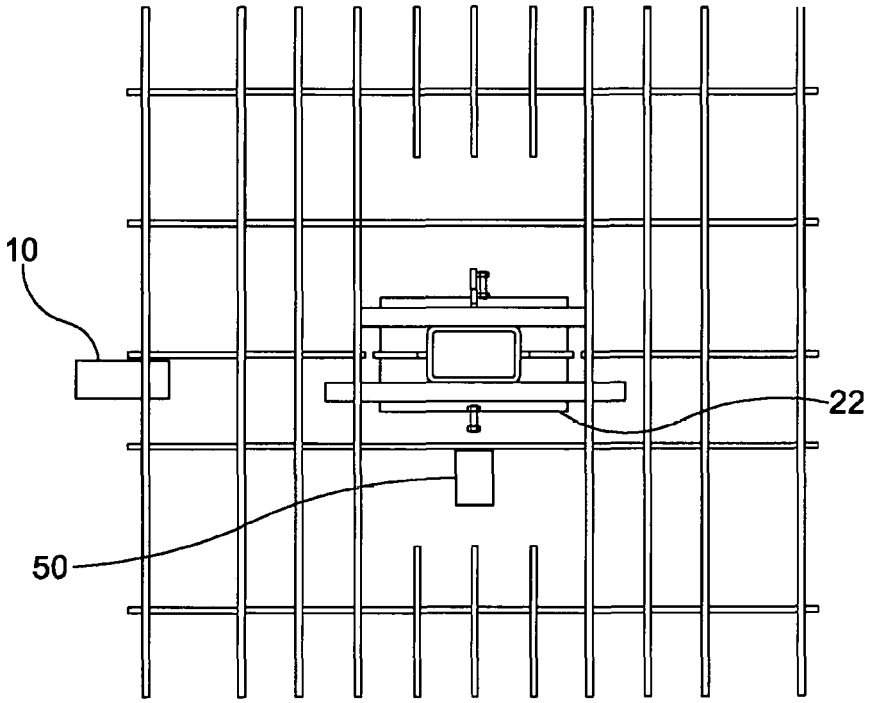
FIG. 9 shows a rebar cage and post footing for use in the barrier foundation.

Referring to FIG. 9, a steel reinforcement cage for a barrier post foundation 7 is shown. The reinforcement cage shown is one suitable for an end post of the design and it will be appreciated that an anchor post 10, such as that shown in FIG. 8, can also be located in this footing.

Although shown in plan view, it will be appreciated that each of the pieces of reinforced steel bar shown are in fact rectangular loops and will have a height of approximately 320 mm.

The footing 22 is located within the reinforced steel bar cage. In addition to the footing 22 being located within this steel bar cage, which will itself be contained within the concrete foundation, a steel tube 50 may also be set within the concrete foundation, such that its upper end is accessible once the concrete foundation has been poured around the cage. This tube 50 forms a fence post holder such that if, for aesthetic reasons, it is required to run a fence, for example a standard wooden-type fence, adjacent the security barrier, holders for the fence posts, in the way of these tubes 50, are already provided within the concrete foundations and the fence posts can therefore be quickly and simply installed.

When installing the security barrier of the current design, holes will be dug of a sufficient size to accommodate the reinforcement cages, which will then be placed therein together with the footings. Concrete will then be poured to form the foundations, after which the upright sections of the post 26, 28 can be installed into the tubular section of the footing, and any gaps are filled with grout so as to rigidly retain the upright sections of the posts 26, 28 in the footing 22. The cables 5 can then be placed over the posts 4 at either end of a security barrier section 3 and the U-bolts 6 fitted therethrough. The cables 5 can then be tensioned by hand, for example by using a lever passed through the end of the loop adjacent the post, and the U-bolts clamped in place. It will be appreciated that, with the barrier of the present invention, the tensioning merely serves to ensure there is a small cable loop 20 to allow for the slip and to ensure the cables are not sagging unacceptably between the posts. The tension can therefore be provided manually with a small lever and does not require any specialist tensioning equipment. As will be seen, for example from FIGS. 4 and 5 and FIG. 2, the U-bolts 6 are sized such that the cables 5 can be moved vertically within the U-bolts 6 to adjust their height when being fitted, and the U-bolt is then clamped to retain the cables 5 at this required height. In this way, small changes in the level of the ground from one post to the next can be effected to maintain the cables at their proper desired height.

It will be appreciated that, as the security barrier 2 is made up of a plurality of security barrier sections 3, each of which have their own cables 5, the installation of the cables 5 by looping either end thereof over adjacent posts 4 is a relatively simple and straightforward installation process, which may be undertaken manually without the need for any specialised equipment. Furthermore, it will be appreciated that as the security barrier 2 comprises a plurality of adjacent security barrier sections 3, and as the cables 5 of each of the security barrier sections 3 each have a limited slip, then the time period over which the impact is absorbed within the barrier 2 is further increased by the accumulative slipping of a number of adjacent cables 5 of adjacent security barrier sections 3.

It will be appreciated that, in contrast to previously known cable barrier fences, which typically run to sections in excess of fifty meters, and often in the order of one hundred or two hundred meters, and for which the cable must be tensioned over these lengths, for the present invention, which requires only that the cables 5 are pulled reasonably tight and which uses short cables 5 in the order of seven to eight meters, the installation process is greatly simplified and negates the use of the large machinery necessary for handling hundreds of meters of metal cable. It is a further advantage of the present invention that when it is necessary to place a barrier in uneven ground, for example where a barrier of several hundred meters in length is required to go over terrain at varying levels, as in the present invention, it is not necessary to tension great lengths of cable. In known designs, wherein cables of one hundred meters or more length are tensioned, this tensioning of the cable is often not possible where the ground changes height, as tensioning of the cable introduces a vertical upwards or downwards force upon individual fence posts. In the present invention, as the tensioning of the cables 5 does not need to apply any great longitudinal force, and as what little tension is required from the cable 5 is only applied between adjacent posts 4, this problem is rendered moot and the security barrier 2 of the present invention can easily traverse uneven or modulating terrain. Furthermore, it will be appreciated that the fence of the present invention can easily change direction or be placed around a curved perimeter, which is not the case in tensioned cable systems wherein, particularly in the case of a curved perimeter, tensioning the cables would provide an undesired sideways force on the posts which, if they are built sufficiently strong to resist this sideways movement, will require very substantial foundations which may, for example, be several meters in depth.

Figure 11A:
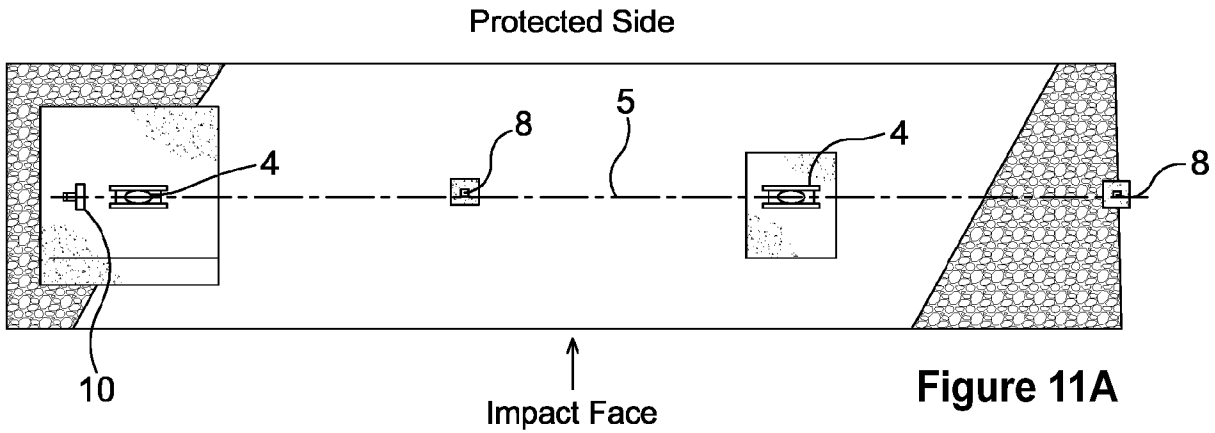
FIGS. 11A and 11B are top and side views, respectively, showing the setup used in the testing of the invention.
Figure 11B:
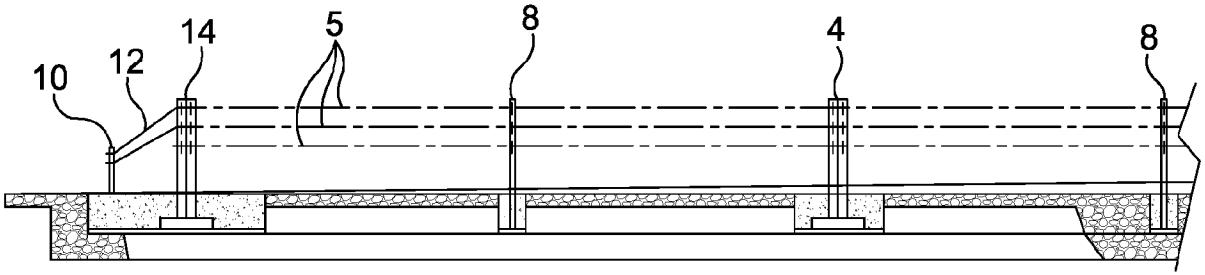

Referring now to FIGS. 11A and 11B, a test foundation arrangement is shown. It will be appreciated that the drawings show half of the installation, the remainder of the installation being a mirror image of the half shown about the central support post 8.

The preparation of the test area was as follows. A trench was excavated 25 meters long and 3 meters wide to a depth of 750 mm. Compacted type one material was then added in layers of 150 mm to a depth of 300 mm. The reinforcement cages for the footings were set on a thin (50 mm) layer of blinding applied to the compacted type one material, and wooden form work constructed around the cages was filled with concrete. The remainder of the trench was back-filled to ground level with type one material compacted in layers of 150 mm. The fence which was tested was as shown in FIG. 1, i.e., an end post 4 having an anchor post 10 sharing a common foundation was provided at either end, two Intermittent security barrier posts 4 were provided, and between the security barrier posts 4 three support posts 8 were provided. The security barrier posts 4 were provided at 7320 mm centres resulting in a 7120 mm gap between them and the support posts 8 were provided at the centres of these gaps.

The foundations for the end security barrier posts 4 and the anchor posts 10 were 2000 mm×2000 mm×400 mm deep, the concrete foundations for the security barrier posts 4 between the end posts were 1000 mm×1000 mm×400 mm deep, and the foundations for the support posts 8 were 200 mm×200 mm×400 mm deep, with 100 mm depth of blinding under the foundation. The footings of the security barrier posts 4 were to the design shown in FIGS. 4 to 7, and the support post 8 was to the design shown in FIG. 8. Each post upright 26, 28 was made of spring steel and was 100 mm wide by 50 mm deep, resulting in the total size of the security barrier posts comprising four such post uprights being 200 mm wide by 100 mm deep. The support posts 8 were made of regular steel. The upper, middle and lower cable were all made of 22 mm multi-strand steel wire. The U-bolts were all tightened to a torque of 75 pounds force inch. Other arrangements may be useful.

The concrete used for the foundations was Grade C40/50 (BS EN 206:2013/BS 8500 2006) with 10 mm grit and was allowed to dry prior to the upright posts being fitted into the foundations. Once fitted, the posts 26, 28 were grouted into the tubular section of the boxes. In order to tighten the slings, a simple lever bar was placed through the end of the loop and it was levered out whilst the U-bolts were tightened.

The type one material in the trench is used to simulate the application of a fence in a soft ground environment, as opposed to solid concrete which has previously been used for testing these types of fences, irrespective of their final application.

The fence was tested by a controlled 90° collision with a 7.5 tonne truck, in accordance with BSI PAS 68:2010 testing.

The fence of the size shown met the requirements of BSI PAS 68:2010, and was the first known security barrier ever to have passed this test for soft ground testing with footings of less than 1 m depth. Furthermore, in contrast to known wire fences, due to the unique design of this fence in short sections with individual cables, only a short section of fence was damaged, as opposed to a section around 100 m in length as with other previous fences. As will be appreciated, it is also an advantage of the present fence over those that have long sections of cable that in the event of a deliberate attack on the fence, if the fence is cut, then this must be done at the point of planned vehicular crossing. With previously known fences, the cable could be cut up to several hundred meters away from where the vehicle wants to cross, as, once cut, a large section of the fence will be taken out of commission.

Figure 14:
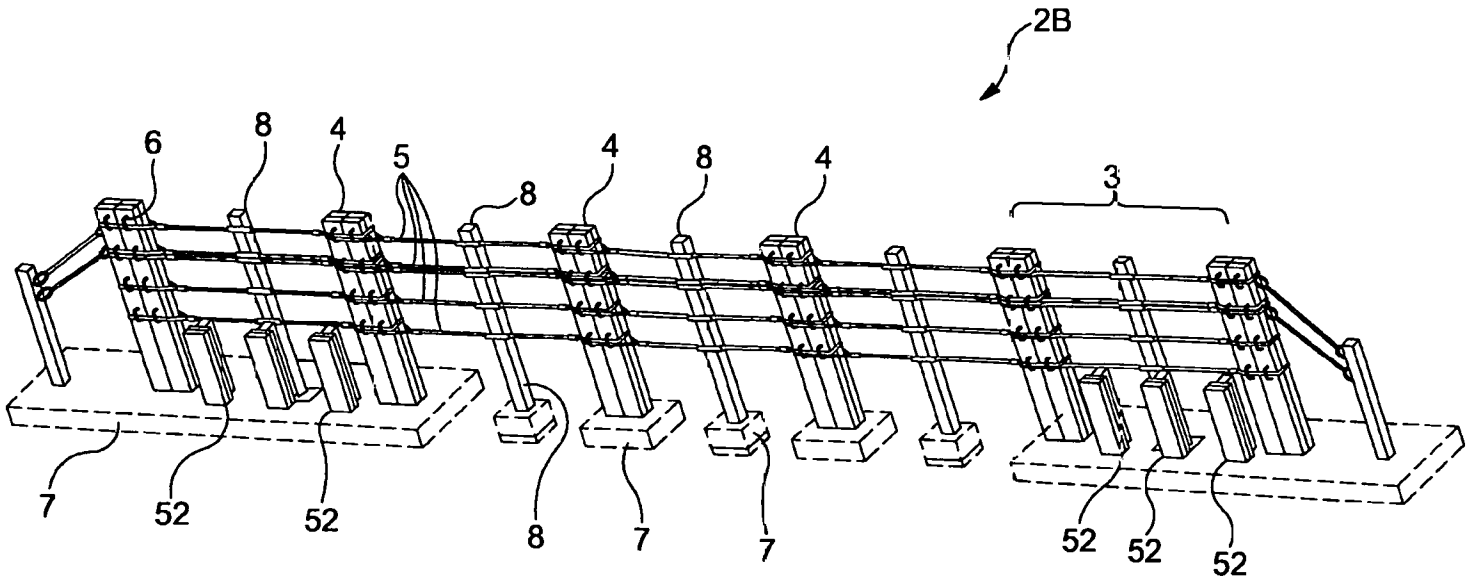
FIG. 14 shows a perspective view of a security barrier in accordance with an embodiment of the present invention.

Now referring to FIG. 14, a test foundation arrangement of a security barrier 2B is shown. Measurements of the setup design are provided in millimeters, but it will be appreciated that, in practice, the setup design need not be realised with millimeter precision. Corresponding elements of security barrier 2B share the same reference numerals with those of security barrier 2.

Consecutive barrier posts 4 of security barrier 2B are about 10 meters apart. A central support post 8 is located half-way between the two barrier posts 4. As can be appreciated, while a shorter distance between posts allows slopes or the contours of uneven terrain to be followed more closely by the security barrier 2B, a larger distance between posts reduces the number of posts per barrier length unit and thus the associated cost and construction time. In FIG. 14, the posts 4 of the end barrier section are provided on a common concrete foundation 7.

The barrier sections 3 of FIG. 14 are provided with five cables 5, wherein the second and third cables from the top are provided as a paired cable sharing the same U-bolts 6. Thus, four lines of cables are provided, the first line comprising one cable at about 1250±20 mm from ground level, the second line comprising a pair of cables at about 1050±20 mm, the third line comprising one cable at about 850±20 mm, and the fourth line comprising one cable at about 600±20 mm. This arrangement increases the strength of the barrier 2B, because the peak impact load may be distributed over a larger number of cables 5, and also ensures that vehicle chassis are caught between about 600±20 to 1250±20 mm height. This arrangement is believed to be suitable for stopping a 7.5 ton truck approaching at a speed of 80 km/h (50 mph). It will be understood that other arrangements involving more or fewer cables distributed over different heights may be employed, depending on the anticipated velocity and/or the typical chassis height of an assault vehicle.

The construction of the foundations 7 of the embodiment of FIG. 14 is largely the same as for that of FIG. 11 described above, with the exception that a common concrete foundation 7 is provided for all posts of the end barrier sections, i.e. for the two barrier posts 4 of the end barrier section, for an anchor post 10, and for three impact posts 52. Thus, the common concrete foundation 7 for the end barrier section 3 measures 2000 mm×12200 mm×400 mm depth in order to accommodate the barrier posts 4 that are 10 meters apart. The concrete foundations 7 for the mid-barrier posts are the same as described with reference to FIG. 11 above, i.e., the concrete foundations 7 for the security barrier posts 4 are 1000 mm×1000 mm×400 mm deep, and the concrete foundations 7 for the support posts 8 are 200 mm×200 mm×400 mm deep, with 100 mm depth of blinding under the foundation.

As shown in FIG. 14, the end barrier section of security barrier 2B comprises three impact posts 52. The three impact posts 52 are located approximately equidistantly spaced apart between the two barrier posts 4 of the end section. Each impact post 52 is 100 mm wide and stands up about 550 mm above ground. The distance between each barrier post 4 and adjacent impact post 52 is 2425 mm and, likewise, the distance between adjacent impact posts 52 is 2425 mm. It will be appreciated that any number of posts can be used, but preferably the number is such that the distance between the impact posts is less than the width of a truck, thereby preventing trucks from driving between the impact posts.

In the embodiment of FIG. 14, the support posts 8 of the end barrier section are not set into a footing 22. Instead, the end section support post 8 comprises a base plate which is bolted to the concrete foundation using four ISO 261:1998 M12 bolts. Being bolted to the concrete foundation 7 via a base plate, the support post 8 is sufficiently sturdy to prevent sagging of the cables 5 between the barrier posts 4.

Figure 15:
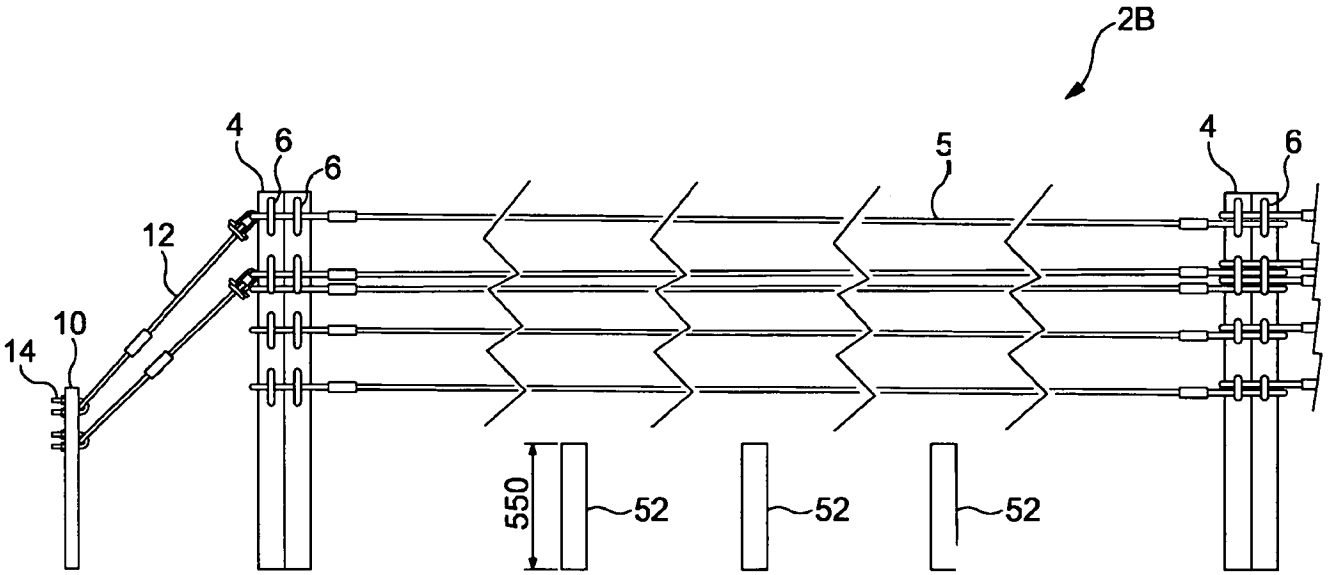
FIG. 15 shows a side view of the end barrier section of the security barrier of FIG. 14.

Turning to FIG. 15, it will be appreciated that only the above-ground sections of the security barrier 2B section are shown. Note that, for increased clarity, no central support post 8 and no concrete foundations 7 are shown in FIG. 15. The impact posts 52 are designed to stand to a height of 550 mm, i.e. below the lowest cable 5 that runs at about 600±20 mm. Thereby, impact posts 52 are lower than a conventional bumper of a truck. Thus, an assault vehicle hitting the barrier 2B is slowed down by impacting on the cables 5 and, as the assault vehicle pushes further into the barrier, damage is caused to the undercarriage of the assault vehicle as it rides over one or more of the impact posts 52.

Figure 16A:
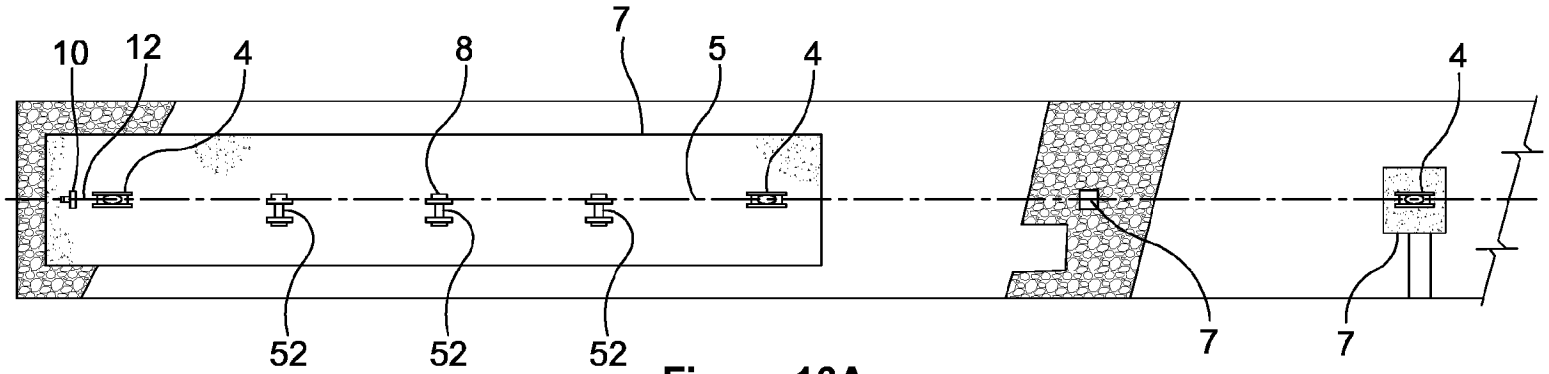
FIGS. 16A and 16B show a top view and a side view, respectively, of the setup used in the testing of the embodiment in accordance with FIG. 14.
Figure 16B:
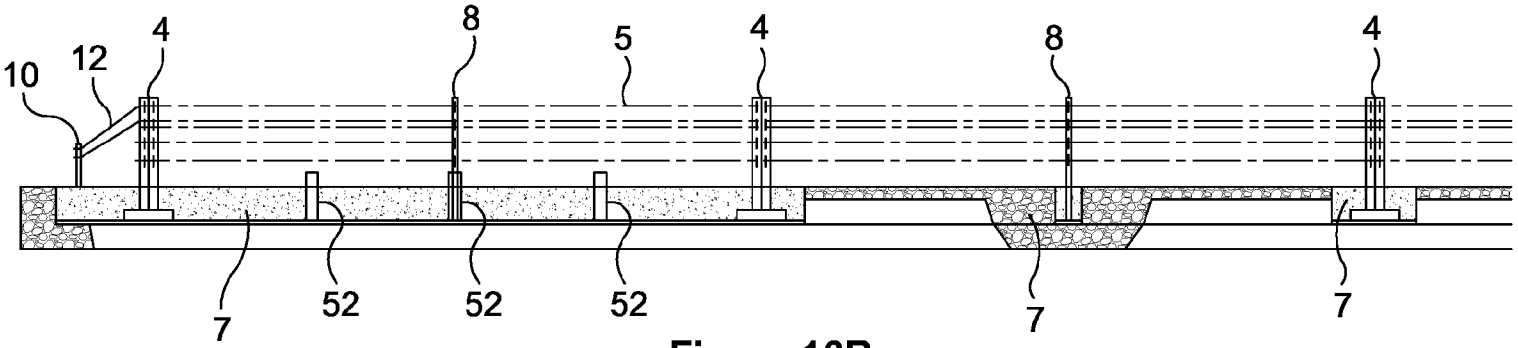

The views of FIGS. 16A and 16B show that the impact posts 52 are lined up along the barrier but positioned about 100 to 200 mm forward of the cables 5, i.e., 100 to 200 mm toward the side from which the impact is expected to arrive. Thereby, the centre impact post 52 can be positioned just forward of the central support post 8, while being laterally aligned. The impact posts 52 are offset to cause larger trucks to impact on the impact posts earlier, whereby the impact posts absorb part of their kinetic energy and reduce the load on the cables 5 upon impact.

Figure 17:
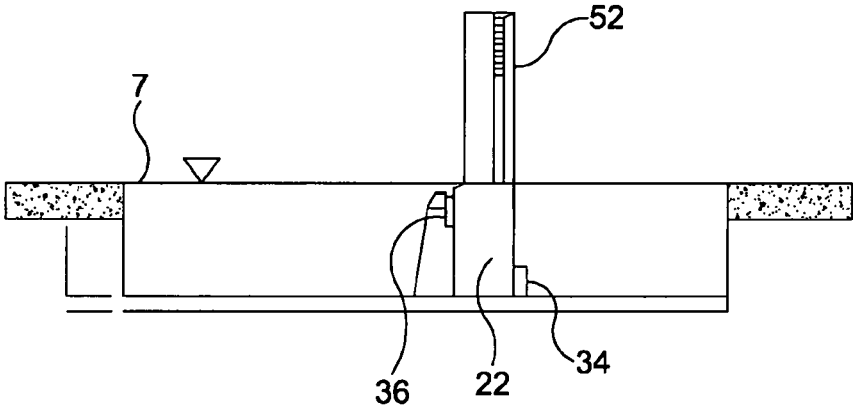
FIG. 17 shows a cross section of a concrete foundation permitting a side view on an impact post in accordance with the embodiment of FIG. 14.

FIG. 17 shows a side view of an impact post 52 in situ in a concrete foundation. Each impact post 52 is set in a footing 22 as described above. I.e., the footing 22 is of a type providing an anchorage within the concrete bed and the footing is configured to resist rotation in response to a forcible impact by way of its foot and top plates 34, 36.

The impact post 52 is a T-section bar, the flat side facing the side from which the impact is expected to arrive. The anchor post is preferably made of spring steel, to provide additional resilience when impacted. A conventional steel post may bend upon impact and form a ramp for the vehicle, whereas a spring steel post twists and turns, and also tends to straighten itself up, and thus poses a resilient obstacle to an assault vehicle. The impact post 52 is set in the footing 22 and grouted into the tubular section of the boxes.

The test arrangement described with reference to FIGS. 14 to 17 was tested by a controlled 90° collision with a 7.5 tonne truck in accordance with BSI PAS 68:2010 testing. It was found to stop a truck approaching at around 80 km/h (about 50 mph). The end barrier sections that are provided with additional impact posts 52 stopped a 7.5 tonne truck approaching at about 80 km/h. To provide an impression of the magnitudes involved, this corresponds to about 218 tonnes of impact.

It is common to set up truck fences along a wide perimeter, around 0.5 miles from an object to be protected, in order to allow more response time in case of a barrier breach. The amount of material and the construction time required for wide perimeter fences adds to their cost. Because the embodiments of the present invention can be designed to immobilise a vehicle, the barrier is more reliable and so it is believed that the perimeter can be reduced to less than 0.5 miles from the object to be protected, which further reduces the cost, because less barrier length is required.

Figure 18:
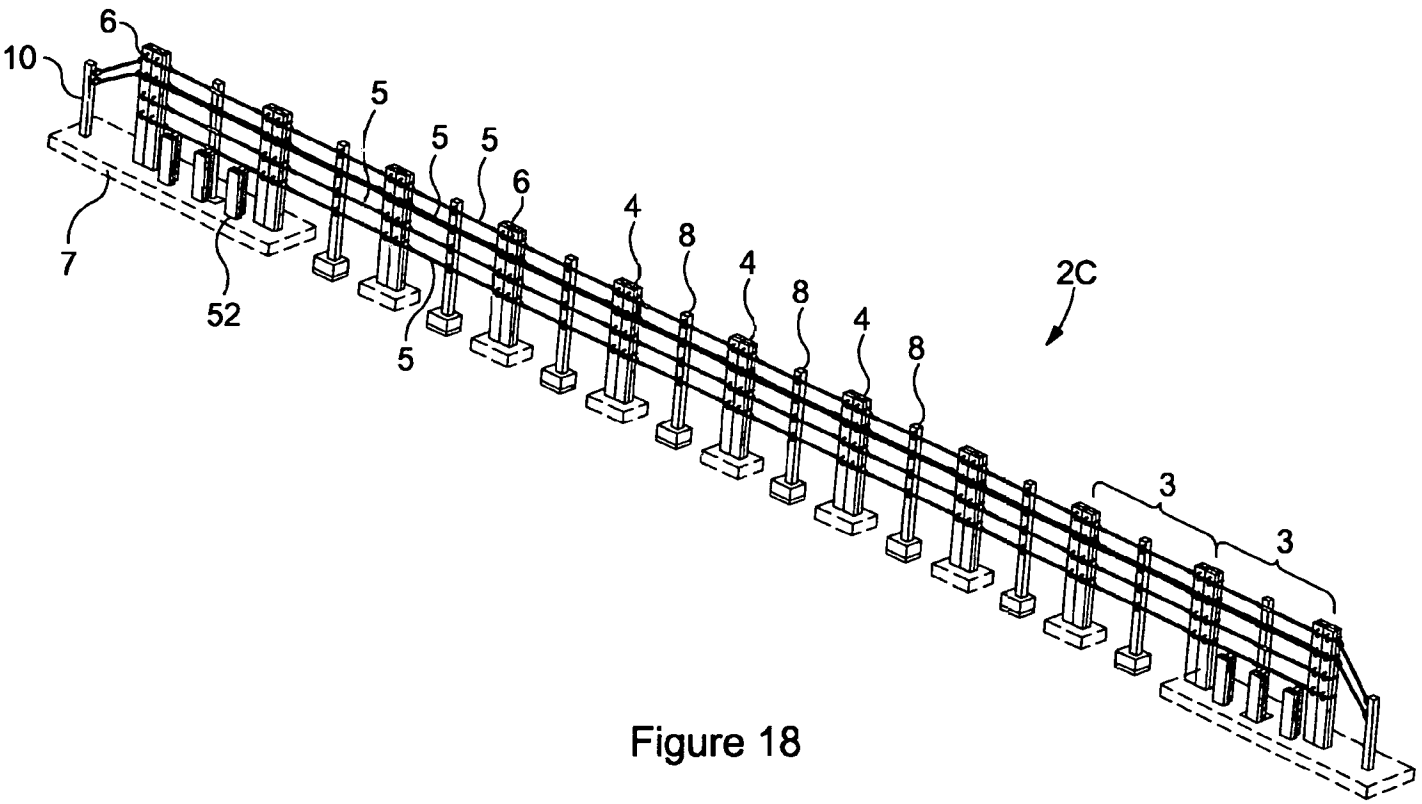
FIG. 18 shows a perspective view of a security barrier in accordance with an embodiment of the present invention.

FIG. 18 shows a security barrier 2C of about 100 meters length. The layout of FIG. 18 is a test setup suitable for the above-mentioned PAS68 test (BSI PAS 68:2010) for hostile vehicle mitigation, or for the ISO IWA 14-1:2013 vehicle security barrier (VSB) impact test conditions. The FIG. 18 setup is akin to FIG. 14, but whereas FIG. 14 shows a 50-meter security barrier 2B, the FIG. 18 security barrier 2C comprises ten barrier sections 3, each designed to measure 10 meters wide. For simplicity, each of the barrier sections 3 of security barrier 2C comprises the arrangement of cables 5 described for security barrier 2B. I.e., there are four lines of cables, the first line comprising one cable at about 1250±20 mm from ground level, the second line comprising a pair of cables at about 1050±20 mm, the third line comprising one cable at about 850±20 mm, and the fourth line comprising one cable at about 600±20 mm. About half-way between two barrier posts 4 of each barrier section 3, a support post 8 is provided. Each end barrier section 3 further comprises an anchor post 10 and three impact posts 52, in the manner described above with reference to FIGS. 15 to 17. The exact configuration of security barrier 2C may vary in the manner described above with reference to the other embodiments, e.g., the barrier sections 3 may be more or less than 10 meters long; or there may be more or fewer cables 5, which may be distributed as required for an anticipated assault vehicle.

Figure 19:
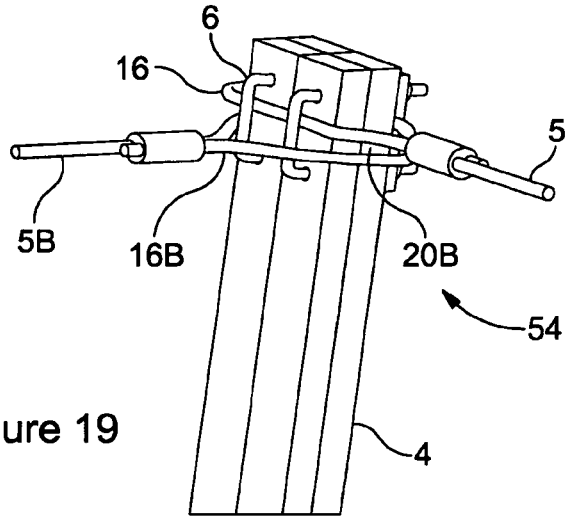
FIG. 19 shows a schematic perspective view of a corner arrangement in accordance with an embodiment of the present invention.
Figure 20:
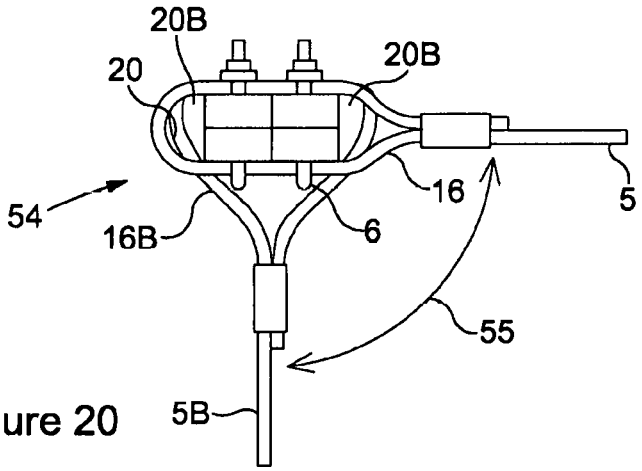
FIG. 20 shows a top view of a corner arrangement in accordance with an embodiment of the present invention.
Figure 21:
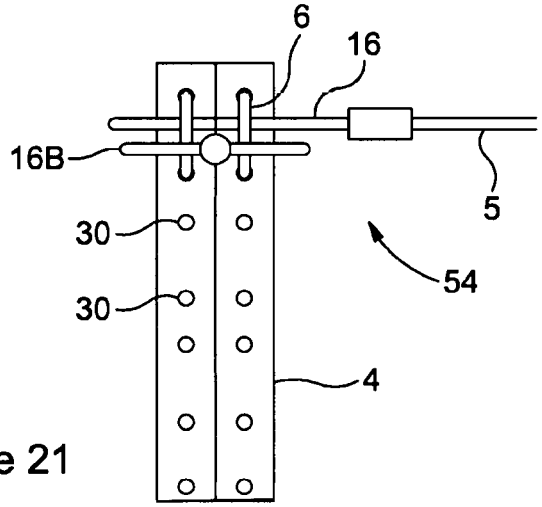
FIG. 21 shows a front aspect view of a corner arrangement in accordance with an embodiment of the present invention.

FIGS. 19 to 21 show a corner arrangement 54. Corner arrangement 54 comprises a post 4 as described above with reference to FIGS. 3B, 4 and 5. Post 4 carries a loop 16 of a cable 5 clamped by U-bolts 6. The corner arrangement 54 is characterised in that a loop 16B of a second cable 5B is attached to the post 4, wherein the second cable 5B is oriented, relative to the first cable 5, at an angle 55 (viewed from above, indicate in FIG. 20) of about 90 degrees. The loop 16B is held in place by the plates and nuts of U-bolts 6. The angle 55 may have other values, depending on geometry. E.g., the cables may meet at an included angle of less than around 170, 160, 150, 140, 135, 130, 120, 110, 100, or 90 degrees. Surprisingly, the angle may also be acute, e.g., an included angle of less than around 80, 70, 60, 50, 45, 40, 30, or 20 degrees. By "around", it is meant that the angle may, for practical purposes, vary between ±10 degrees or ±5 degrees. The more obtuse the angle, the better the bilateral support from the cables connected to the post 4. However, the inventors found that, surprisingly, the present invention also allows a sufficiently strong resistance to be achieved with cables connected at a right angle, or even at an acute angle. This is because even although an acute-angle arrangement may, upon impact, have an initial slack, the cables and post configuration of the invention still absorb energy of the incoming vehicle for the purpose of bringing it to a halt.

As shown in FIGS. 19 to 21, it is implied that, for the assembly of a barrier, the loop 16B is pulled over the post 4 before loop 16. The loop 16B is held in its vertical position by the U-bolts 6. In particular, as shown in FIGS. 19 to 21, the loop 16B is held in place by back plates of U-bolts 6. However, any clamping means can be used as long as they allow the loop 16B to be fixed with a small gap 20B to permit slipping upon impact. The second cable 5B should be as tight as possible to avoid excessive sagging of the cable 5B. However, a small amount of slack is not a problem, firstly because the cable can be kept at a desired height by support posts 8 (not shown in FIGS. 19 to 21, but shown, e.g., in FIG. 22), and secondly because upon impact the cable 58 will be pulled taught. Loop 16B is prevented from being pulled off the post, by adjacent loops 16.

As shown in FIGS. 19 to 21, the post 4 carries only one cable 5 and one cable 5B. Of course, more cables may be attached, using additional clamping means (e.g., U-bolts) through holes 30.

Figure 22:
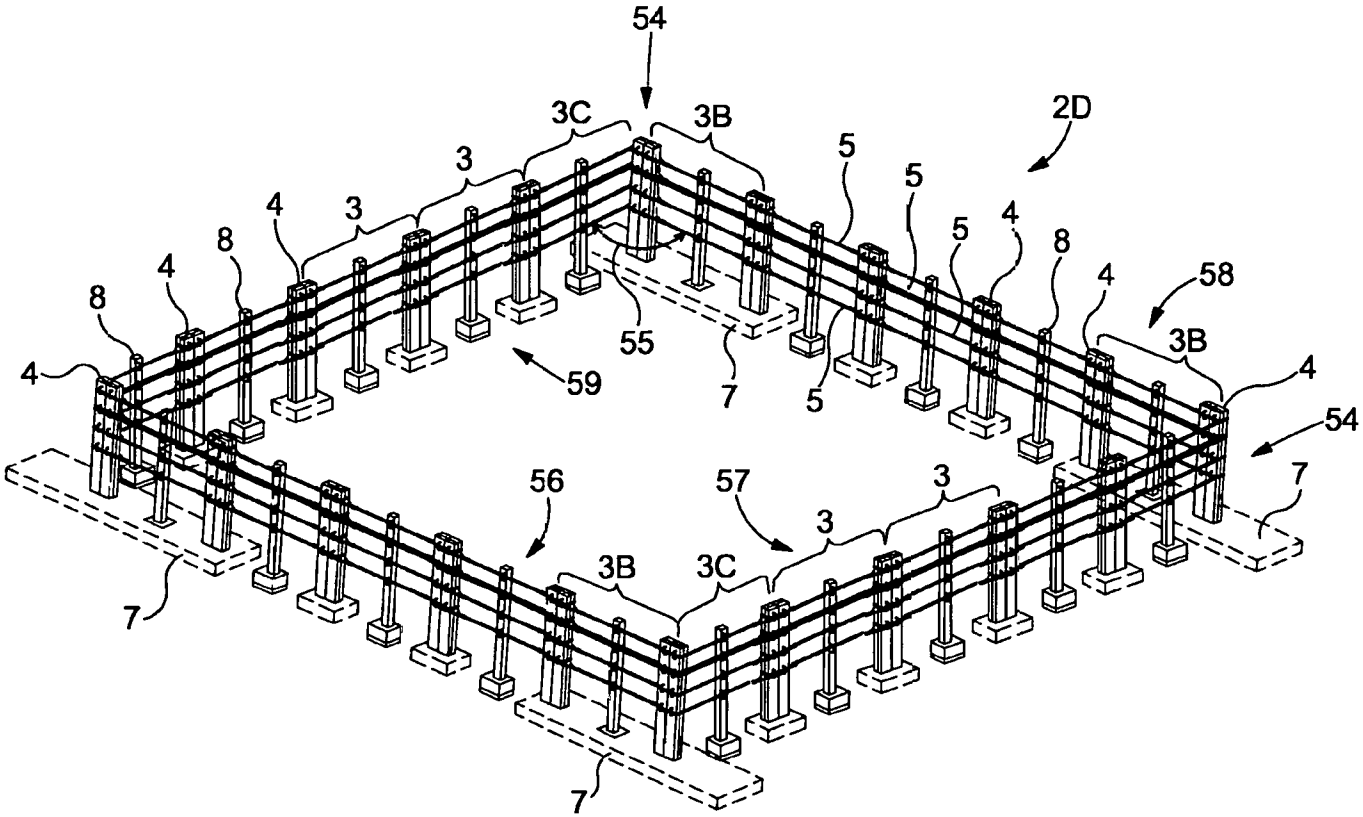
FIG. 22 shows a perspective view of a security barrier in accordance with an embodiment of the present invention.

The corner post arrangement 54 is suitable for barrier section posts between two adjacent barrier sections. This is advantageous for layouts such as that shown in FIG. 22. FIG. 22 shows a security barrier 2D. Security barrier 2D encloses a square perimeter measuring 50 meters by 50 meters. The security barrier 2D comprises four sides, a front side 56, rear side 58, and lateral sides 57 and 59. The front side 56 is the side from which an impact is expected to arrive, or from which an impact is deemed more likely than from another direction. Each side comprises five ten-meter barrier sections 3 akin to those described with reference to FIG. 14. I.e., each barrier section 3 comprises a support post 8 between two posts 4 carrying five cables 5.

Front side 56 and rear side 58 are similar to security barrier 2B, each comprising five barrier sections 3, of which the two end barrier sections 3B are embedded in a common concrete foundation 7 extending about 2000 mm×12200 mm and being about 400 mm deep. However, there are no anchor posts 10 or impact posts 52, although these could be included. The 2000 mm×12000 mm concrete bed is provided to facilitate alignment of the barrier sections constructed first during construction.

The lateral sides 57 and 59 are erected between the front side 56 and the rear side 58 to form a square. The lateral sides 57 and 59 are, each, comprised of three consecutive barrier sections 3 as described above, and comprise additionally two connector sections 3C. For each lateral side 57, 59, the two connector sections 3C provide a connection to the adjacent end posts 4 of the end barrier sections 3B of the front side 56, or of the rear side 58, respectively. The connection is achieved using the corner arrangement 54 described above. I.e., one end of each cable 5B of a connector section is provided with a loop 16B and mounted at an angle 55 of about 90° to the post 4 of the end barrier section 3B. Once connected to the respective posts 4 of end barrier sections 3B, the connector sections 3C constitute a barrier section comprising two posts 4 and a support post 8. Thus, the lateral sides 57 and 59 each comprise five ten-meter barrier sections.

Once assembled, each barrier section 3 of the security barrier 2D is laterally supported by an adjacent barrier section, because each pair of adjacent barrier sections 3 shares a common barrier post. This further increases the capability for withstanding vehicle impact. Thus, security barrier 2D does not comprise impact posts, such as impact posts 52 shown in FIG. 14 for security barrier 2B. The square layout of security barrier 2D is exemplary, and other layouts may be used, such as rectangular, rhomboid, or generally quadrilateral, hexagonal, or any other polygonal layout. The security barrier 2D is suitable as a vehicle barrier surrounding, and protecting all sides of, installations such as antennas, power substations, storage tanks, pylons, and the like. Such installations are often located near roads to permit access for maintenance purposes, and the security barrier 2D provides a strong protection perimeter.

The corner arrangement 54 may also be used in combination with the end barrier section described above. E.g., an anchor post 10 may be provided for additional support. Further, a corner arrangement 54 may be used part-way along the barrier, e.g., to provide an open security barrier with a three-side (U) layout, a two-side (V) layout, a zigzag (W) layout, a staggered layout, or a meandering layout.

Figure 23:
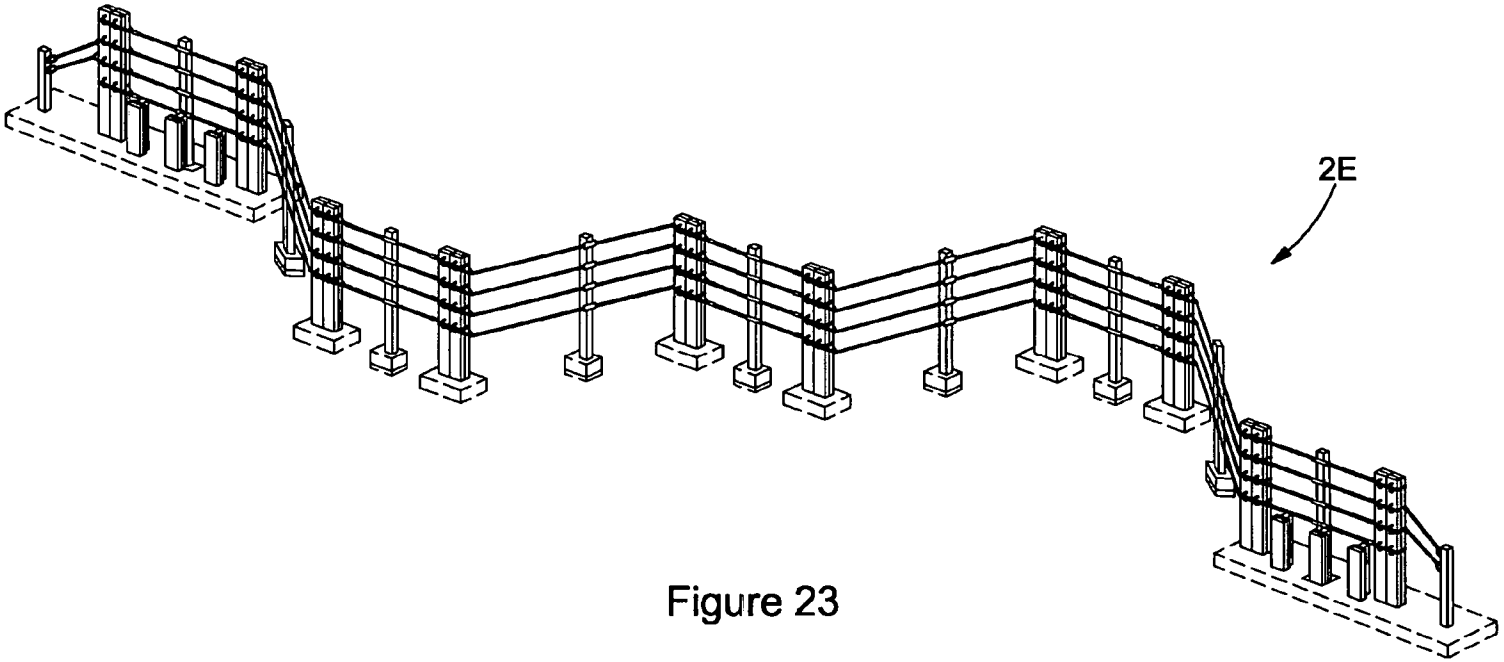
FIG. 23 shows a perspective view of a security barrier in accordance with an embodiment of the present invention.

FIG. 23 shows a security barrier 2E comprising nine barrier sections 3 connected by a plurality of corner posts and meeting at an included angle 55 of about 135 degrees. Thus, security barrier 2E has staggered, or meandering, layout, as adjacent barrier sections are offset, or staggered, relative to each other. The remaining features of security barrier 2E are equivalent to security barrier 2B or security barrier 2C (described with reference to FIGS. 14 and 18).

Figure 24:
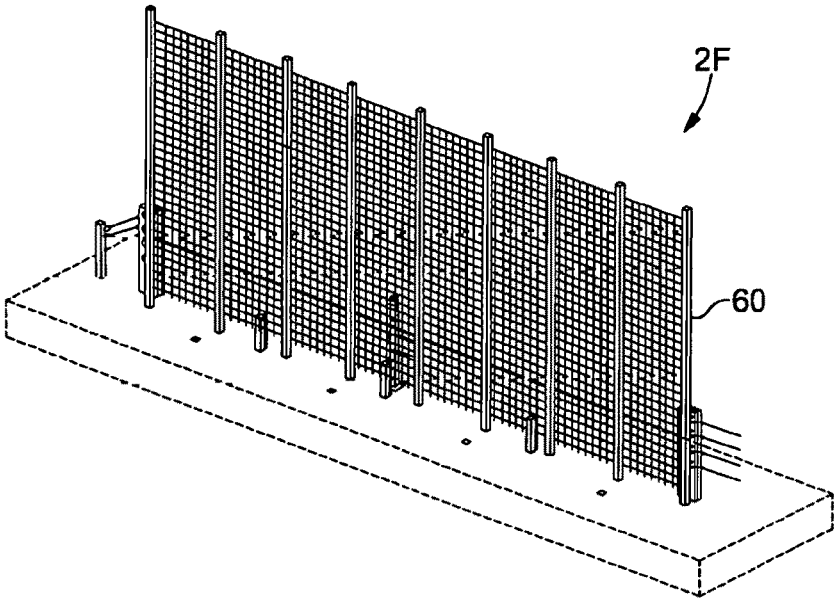
FIG. 24 shows a perspective view of a security barrier in accordance with an embodiment of the present invention.

FIG. 24 shows an end section 3 of a security barrier 2F. Security barrier 2F comprises the components of a security barrier as explained above. In addition, a fence 60 is mounted with the security barrier.

Figure 25:
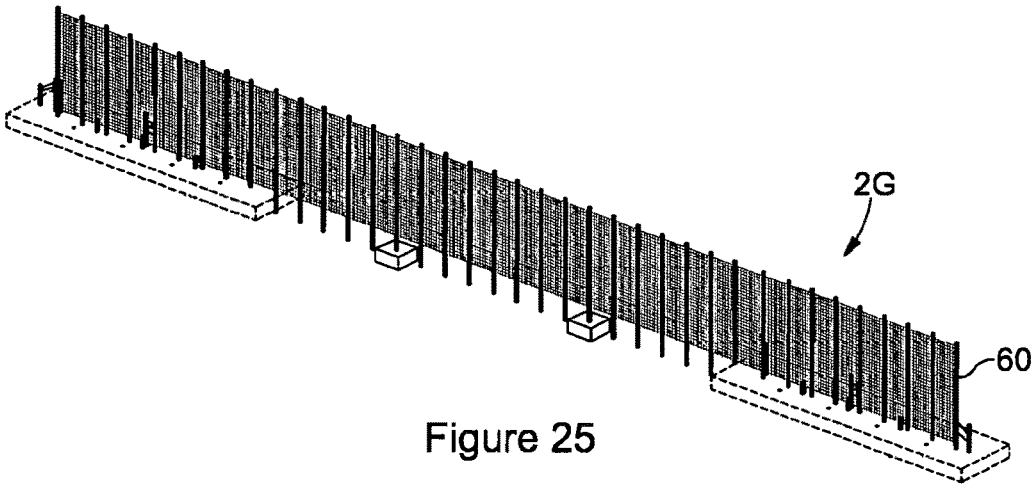
FIG. 25 shows a perspective view of a security barrier in accordance with an embodiment of the present invention.

FIG. 25 shows a security barrier 2G. Security barrier 2G corresponds to security barrier 2B, described above with reference to FIG. 14, and comprises an additional fence 60.

Fence 60 may be of any height or construction as may be required to hinder trespassing or climbing by individuals, or to provide visual protection. It is not necessary that the fence 60 is configured particularly for withstanding an impact by a vehicle, because the vehicle impact mitigation function Is provided by the cables of the barrier sections.

As mentioned above, the provision of relatively short barrier sections (i.e, barrier sections in the region of 10 meters, rather than 50-100 meters) has advantages when one or more of the sections need to be repaired. For instance, cables and posts are commonly galvanised to prevent corrosion. However, the layer of galvanisation may gradually wear away, thinning at between 1 to 1.5 microns per year. The thinning rate depends in part on the environment and may occur considerably faster near motorways (due to exhaustion gases) or in seaside installations (due to exposure to sea water and/or salt spray). Thus, the likelihood of rust spots appearing depends on factors including the thickness of the galvanised layer, and environmental exposure. The ability to repair a short barrier section, or even only selected cables of a section, is thus advantageous, as this can be limited to sections affected by corrosion, reducing cost and downtime.

Likewise, the present invention allows part of the barrier to be opened up to provide a passage. For instance, if due to changes in site layout, a gateway is required along the barrier, this can easily be achieved by removing one or more sections and, e.g., replacing these with end barrier sections.

Any such repairs or alterations to one or more barrier sections can be made without affecting the barrier function of the remaining barrier sections.

The invention claimed is:

1. A security barrier comprising a plurality of security barrier sections, each said security barrier section comprising:

two barrier section posts; and at least one cable having two ends, said at least one cable extended between said two barrier section posts and attached thereto, adjacent each said end, by attachments, wherein said attachments at each said end are configured to allow said cable to slip in said attachment under loading, and wherein said at least one cable comprises a stop at each end thereof and wherein the extent of slip of said at least one cable in said attachment is limited by said stops, and wherein a loop is formed in at least one end of said at least one cable, and said loop passes over one of the barrier section posts, said loop forming said stop, wherein:

adjacent security barrier sections share a common barrier section post;

said attachments comprise U-bolts passing through said security barrier section posts;

and said at least one cable of adjacent security barrier sections shares common U-bolts.

2. The security barrier according to claim 1, further comprising a further post at least one end thereof, said further post set in a common concrete bed with the adjacent end one of said barrier section posts.

3. The security barrier of claim 2, wherein the further post and both barrier section posts of an end security barrier section of said security barrier are set in a common concrete bed.

4. The security barrier according to claim 1, wherein both barrier section posts of an end security barrier section of said security barrier are set in a common concrete bed.

5. The security barrier according to claim 1, further comprising at least one further cable extended between a further post located adjacent a barrier section post at one end of said security barrier, and the adjacent barrier section post.

6. The security barrier according to claim 5, wherein said at least one further cable is attached to said further post and said adjacent end one of said barrier section posts by attachments, and wherein said attachments are configured to, under loading, allow said cable to slip in said attachment, and wherein said attachments comprise U-bolts.

7. The security barrier according to claim 1, wherein at least one common barrier section post constitutes a corner arrangement between two adjacent barrier sections, the two adjacent barrier sections meeting at an included angle of less than 180°.

8. The security barrier according to claim 7, wherein the included angle is one of: 170°, 160°, 150°, 140°, 135°, 130°, 120°, 110°, 100°, 90°, 80°, 70°, 60°, 50°, 45°, 40°, 30°, or 20°.

9. The security barrier section according to claim 1, wherein said U-bolts are tightened to a torque in a range of 50 to 100 inch-force pounds.

10. A security barrier comprising a plurality of security barrier sections, each said security barrier section comprising:

two barrier section posts; and at least one cable having two ends, said at least one cable extended between said two barrier section posts and attached thereto, adjacent each said end, by attachments, wherein said attachments at each said end are configured to allow said cable to slip in said attachment under loading, and wherein said at least one cable comprises a stop at each end thereof and wherein the extent of slip of said at least one cable in said attachment is limited by said stops, and wherein a loop is formed in at least one end of said at least one cable, and said loop passes over one of the barrier section posts, said loop forming said stop, wherein:

adjacent security barrier sections share a common barrier section post;

said attachments comprise clamps; and said at least one cable of adjacent security barrier sections shares one or more common clamp.

11. The security barrier section according to claim 10, wherein a crimp is attached to at least one end of said at least one cable, said crimp forming said loop.

12. The security barrier section according to claim 10, wherein said clamps comprise one or more U-bolts passing through holes provided in said barrier section posts.

13. The security barrier section according to claim 12, wherein said U-bolts are tightened to a torque in a range of 50 to 100 inch-force pounds.

14. The security barrier section according to claim 10, wherein the at least one cable comprises a multi strand steel cable.

15. The security barrier section according to claim 10, wherein each said barrier section post comprises a footing for anchoring it in the ground, and wherein each said barrier section post extending from the footing and to which said at least one cable is attached includes a resilient section provided between said at least one cable and said footing, said resilient section comprising spring steel.

16. The security barrier section according to claim 10, wherein each of said barrier section posts is set in a concrete foundation.

17. The security barrier section according to claim 10, including a further post located between said two barrier section posts and configured to support said at least one cable.

* * * * *